US010407994B2

(12) United States Patent
Thomas et al.

(10) Patent No.: US 10,407,994 B2
(45) **Date of Patent: *Sep. 10, 2019**

(54) METHOD AND SYSTEM FOR A HOLE OPENER

(71) Applicant: Bit Brokers International, Ltd., West Frankfort, IL (US)

(72) Inventors: Timmy Dean Thomas, Logan, IL (US); Cliff Allen Thomas, Thompsonville, IL (US)

(73) Assignee: Bit Brokers International, Ltd., West Frankfort, IL (US)

( * ) Notice: Subject to any disclaimer, the term of this patent is extended or adjusted under 35 U.S.C. 154(b) by 6 days.

This patent is subject to a terminal disclaimer.

(21) Appl. No.: 15/997,233

(22) Filed: Jun. 4, 2018

(65) Prior Publication Data

US 2018/0283105 A1 Oct. 4, 2018

Related U.S. Application Data

(63) Continuation of application No. 15/608,277, filed on May 30, 2017, now Pat. No. 9,988,851, which is a continuation of application No. 14/600,458, filed on Jan. 20, 2015, now Pat. No. 9,689,208.

(60) Provisional application No. 61/931,869, filed on Jan. 27, 2014.

(51) Int. Cl.

| | |
|---|---|
| ***E21B 10/28*** | (2006.01) |
| ***E21B 7/30*** | (2006.01) |
| ***E21B 10/26*** | (2006.01) |
| ***E21B 10/567*** | (2006.01) |
| *E21B 10/30* | (2006.01) |

(52) U.S. Cl.

CPC ..... *E21B 10/28* (2013.01); *E21B 7/30* (2013.01); *E21B 10/26* (2013.01); *E21B 10/567* (2013.01); *E21B 10/30* (2013.01); *Y10T 29/4973* (2015.01)

(58) Field of Classification Search

CPC combination set(s) only.

See application file for complete search history.

(56) References Cited

U.S. PATENT DOCUMENTS

| | | | |
|---|---|---|---|
| 1,764,373 | A | 6/1930 | Wells et al. |
| 1,937,742 | A | 12/1933 | Brink |
| 2,174,587 | A | 10/1939 | Love |
| 2,389,906 | A | 11/1945 | Heard |
| 3,556,233 | A | 1/1971 | Lafayette et al. |
| 5,560,440 | A | 10/1996 | Tibbitts |
| 7,048,064 | B1 | 5/2006 | Smith |
| 7,108,082 | B1 | 9/2006 | Anthony et al. |
| 7,137,460 | B2 | 11/2006 | Slaughter et al. |
| 7,152,702 | B1 | 12/2006 | Bhome et al. |
| 8,201,647 | B2 | 6/2012 | Zulak |
| 8,312,941 | B2 | 11/2012 | Mirchandani et al. |
| 9,689,208 | B2 * | 6/2017 | Thomas ..... E21B 7/30 |

(Continued)

*Primary Examiner* — Yong-Suk Ro

(74) *Attorney, Agent, or Firm* — Armstrong Teasdale LLP

(57) ABSTRACT

A hole opener includes a shaft including a plurality of axial slots formed in an outer periphery and spaced circumferentially about the shaft, a plate coupled to the outer periphery between each pair of slots, the plate including fastening wings that extend radially outwardly from each circumferential end of the plate, and a blade extending radially outwardly from a respective one of the plurality of axial slots between a fastening wing of each of adjacent plates, the blade coupled to each fastening wing.

20 Claims, 10 Drawing Sheets

(56) References Cited

U.S. PATENT DOCUMENTS

| | | | | |
|---|---|---|---|---|
| 9,988,851 | B2 * | 6/2018 | Thomas | E21B 7/30 |
| 2011/0079443 | A1 | 4/2011 | Buske et al. | |
| 2013/0248254 | A1 | 9/2013 | Ainge | |

* cited by examiner

METHOD AND SYSTEM FOR A HOLE OPENER

CROSS REFERENCE TO RELATED APPLICATIONS

This application is a continuation application of application Ser. No. 15/608,277 filed May 30, 2017, which is hereby incorporated by reference in its entirety.

BACKGROUND

This description relates to down hole tools, and, more particularly, to methods and system for a hole opener.

A process known as horizontal directional drilling is utilized to install a variety of underground utilities in a manner that does not disrupt the surface. In use, a drill machine is used to drill a pilot bore that extends beneath the ground surface from an entry hole at the ground surface (i.e., a starting point) to an exit hole at the ground surface (i.e., an ending point). The pilot bore is drilled by rotating and pushing a ground engaging tool (e.g., a drill bit) that is attached to the end of a drill rod. The length of the pilot bore is extended by stringing multiple rods together to form a drill string. The direction of drilling can be controlled (i.e., the drill string can be "steered") by various techniques to control the depth of the pilot bore as well as the location of the exit hole. The location of the drill string, after the pilot bore is completed, represents the desired location of the utility to be installed.

After the pilot bore is drilled, the drill bit is typically removed and a second ground engaging tool installed onto the end of the drill string. This tool is typically known as a hole opener. Its function is to ream/open the drilled bore to a diameter sufficient to allow installation of the utility. To provide a reaming function, the back reamer is typically pulled back through the pilot bore by the drill string as the drill string is withdrawn from the pilot bore. Oftentimes the utility being installed is attached with a swivel located at the end of the back reamer such that the utility is pulled into the reamed bore immediately behind the back reamer. In this way, the act of withdrawing the drill string will simultaneously result in the installation of the utility.

The type of utilities installed typically includes telecommunications, power, water, natural gas, liquid gas pipelines, potable water pipes and sewers. Due to this large variety of utilities, there is a large variety in the size requirements for the final reamed borehole, and thus a wide range of hole opener sizes is required.

There is a need for improved hole openers that are configured to withstand extreme use conditions and are easily rebuildable.

BRIEF DESCRIPTION

In one embodiment, a hole opener includes a shaft including a plurality of axial slots formed in an outer periphery and spaced circumferentially about the shaft, a plate coupled to the outer periphery between each pair of slots, the plate including fastening wings that extend radially outwardly from each circumferential end of the plate, and a blade extending radially outwardly from a respective one of the plurality of axial slots between a fastening wing of each of adjacent plates, the blade coupled to each fastening wing.

In another embodiment, a method of assembling a hole opener includes providing a shaft having a plurality of axially aligned slots spaced circumferentially about a radially outer periphery of the shaft, coupling a first plate to the radially outer periphery of the shaft between a first pair of adjacent slots, sliding a blade radially inwardly into a respective one of the plurality of axially aligned slots, and coupling the blade to the plate.

In yet another embodiment, a method of replacing cutting blades on a hole opener includes uncoupling the blade from adjacent plates, sliding the blade radially outwardly between the adjacent plates, sliding a replacement blade radially inwardly between the adjacent plates until it is seated in a respective slot in the hole opener, and coupling the blade to the adjacent plates.

BRIEF DESCRIPTION OF THE DRAWINGS

FIG. 1 illustrates an example horizontal drilling system 100 in which a hole opener is used.

FIG. 2 is a partially exploded view of a hole opener subassembly in accordance with an example embodiment of the present disclosure.

FIG. 3 is a perspective view of the hole opener subassembly shown in FIG. 2 in a disassembled state.

FIG. 4 is a perspective view of the hole opener subassembly shown in FIG. 2 during installation of plate.

FIG. 5 is another perspective view of the hole opener subassembly shown in FIG. 2 during assembly.

FIG. 6 is a perspective view of the hole opener subassembly shown in FIG. 2 in a partially assembled state.

FIG. 7 is a perspective view of the partially assembled hole opener subassembly shown in FIG. 2.

FIG. 8 is a perspective view of a another embodiment of a hole opener subassembly.

FIG. 9 is an axial view of an end of hole opener subassembly.

FIG. 10 is a flow diagram of a method of replacing cutting blades on a hole opener, such as, hole opener subassembly.

Although specific features of various embodiments may be shown in some drawings and not in others, this is for convenience only. Any feature of any drawing may be referenced and/or claimed in combination with any feature of any other drawing.

Unless otherwise indicated, the drawings provided herein are meant to illustrate features of embodiments of the disclosure. These features are believed to be applicable in a wide variety of systems comprising one or more embodiments of the disclosure. As such, the drawings are not meant to include all conventional features known by those of ordinary skill in the art to be required for the practice of the embodiments disclosed herein.

DETAILED DESCRIPTION

The following detailed description illustrates embodiments of the disclosure by way of example and not by way of limitation. It is contemplated that the disclosure has general application to embodiments of operating and assembling down hole tools including hole openers in industrial, commercial, and residential applications. Although referred to herein as a hole opener in a horizontal drilling environment, in various other embodiments, the hole opener described herein may also be referred to as a reamer in vertical drilling environments. Hole opener and reamer are used interchangeably herein.

The following description refers to the accompanying drawings, in which, in the absence of a contrary representation, the same numbers in different drawings represent similar elements.

Figure 1:
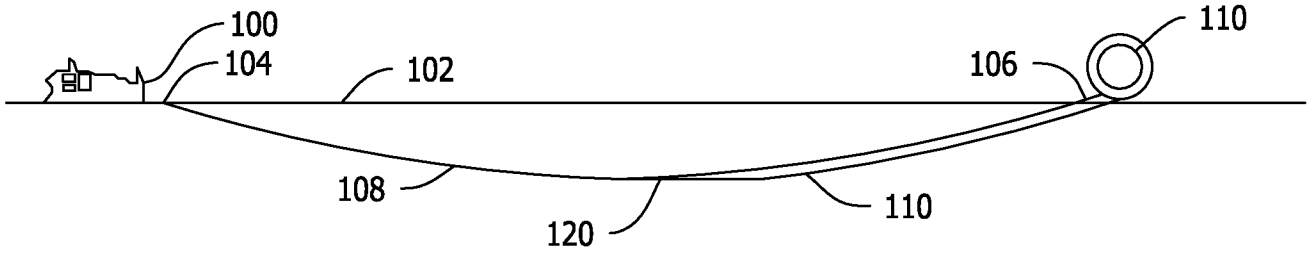
FIGS. 1-10 show example embodiments of the method and apparatus described herein.

FIG. 1 illustrates an example horizontal drilling system 100 in which a hole opener is used. Horizontal drilling system 100 includes a drilling machine 101 depicted as a track-type vehicle. Drilling machine 101 includes anchors (e.g., augers) for securing drilling machine 101 to a ground surface 102. Drilling machine 101 also preferably includes a thrust mechanism for pushing a drill string 108 into the ground to form a pilot bore, and for withdrawing drill string 108 from the ground. Horizontal drilling machine 101 further includes a rotational drive mechanism for rotating drill string 108 as drill string 108 is thrust into the ground or removed from the ground. It will be appreciated that the thrust mechanism of horizontal drilling machine 101 can be oriented at an angle relative to ground surface 102 to facilitate driving drill string 108 into the ground at a desired angle.

In use, horizontal drilling machine 101 is used to drive drill string 108 into ground 102 as shown in FIG. 1. The far end of drill string 108 is typically equipped with a cutting tool for cutting the pilot bore. To lengthen the pilot bore, pipes or rods are sequentially added to drill string 108 until drill string 108 extends from an entry point 104 adjacent to drilling machine 101 to an exit point 106. Thus, drill string 108 is formed by a plurality of drill rods connected together. By rotating drill string 108 while concurrently applying thrust to drill string 108, the cutting tool at the end of drill string 108 cuts the pilot bore.

After drill string 108 has been pushed from entry point 104 to exit point 106, the cutting tool is removed from the far end of drill string 108 and replaced with a hole opener 119. A utility 110 (i.e., a utility pipe) can be attached to hole opener 119 with a swivel 112 such that drill string 108 can rotate independent of utility 110. Once hole opener 119 and utility 110 have been attached to drill string 108, horizontal drilling machine 101 is used to withdraw drill string 108. As drill string 108 is withdrawn, drill string 108 is rotated causing hole opener 119 to enlarge the pilot bore. As drill string 108 is withdrawn, utility 110 is concurrently pulled into the opened bore. As shown in FIG. 1, hole opener 119 has been pulled about halfway back through the pilot bore, and utility 110 has been installed along about half of the bore path.

Figure 2:
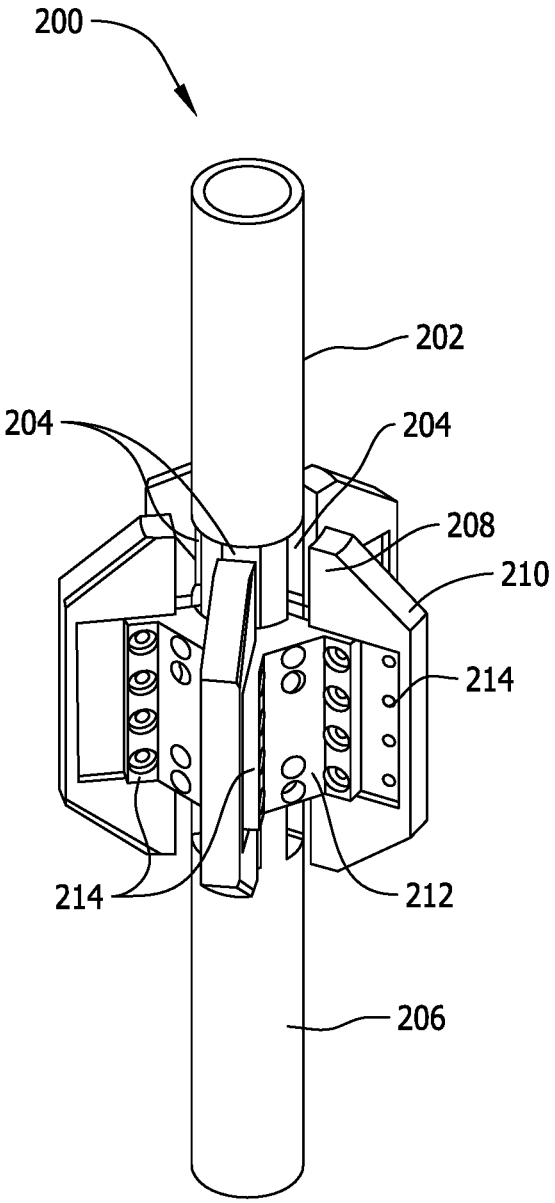

FIG. 2 is a partially exploded view of a hole opener subassembly 200 in accordance with an example embodiment of the present disclosure. In the example embodiment, hole opener subassembly 200 includes a sub shaft 202 having a plurality of axial slots 204 formed in an outer periphery 206 of sub shaft 202. Slots 204 are spaced circumferentially about outer periphery 206 and are configured to receive a radially inward edge 208 of a blade 210. A plate 212 is coupled to outer periphery 206 between each pair of slots 204. Fastening wings 214 extend radially outwardly from each circumferential end of plates 212. Blades 210 are coupled to plates 212 using, for example, fasteners (not shown in FIG. 2) extending though apertures in fastening wings 214 blades 210. Blades 210 are sized in various radial dimensions to accommodate different desired hole sizes. For example, five sets of blades 210 permit 10-inch, 12-inch, 14-inch, 16-inch, and 18-inch hole sizes. In the example embodiment, one size plate 212 is used for 10-inch diameter blades 210 and a second size plate 212 is used for the 12-inch, 14-inch, 16-inch, and 18-inch diameter blades 210.

Blade 210 includes a pocket 216 along a radially inner edge 218 on both sides of blade 210. Slot 204 includes an axially extending narrow portion 220 between two axially extending wider portions 222 at either end of narrow portion 220. Narrow portion 220 and wider portions 222 are complementary to a shape of inner edge 218. During assembly, inner edge 218 fits securely into slot 204 including narrow portion 220 and wider portions 222.

During use, plates 212 are coupled to sub shaft 202 between the plurality of axial slots 204. Blades 210 are slid radially inwardly between plates 212 and seated in a respective one of the plurality of axial slots 204. Blades 210 are then coupled to plates 212 to secure them in position.

Figure 3:
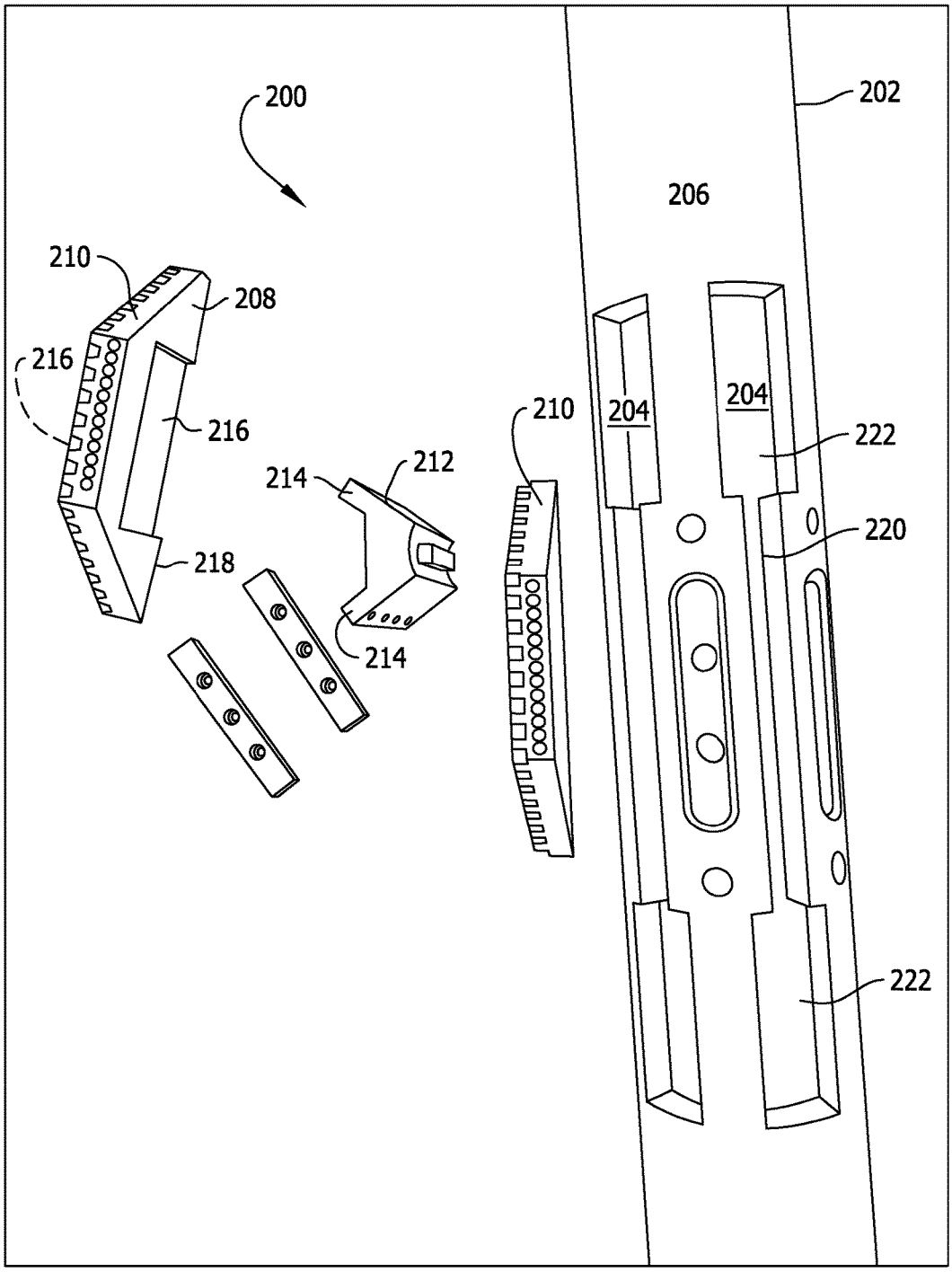
Figure 4:
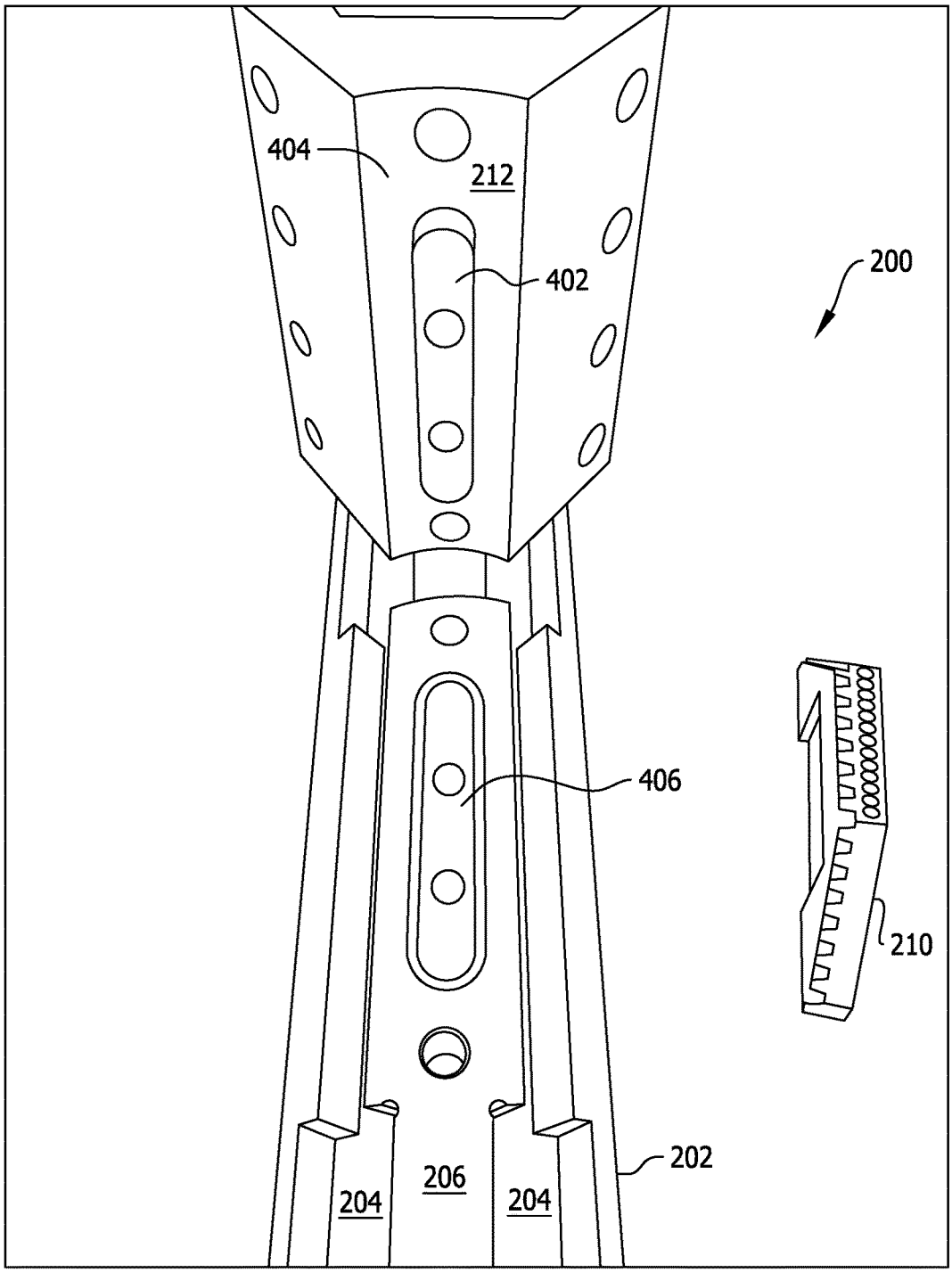
Figure 5:
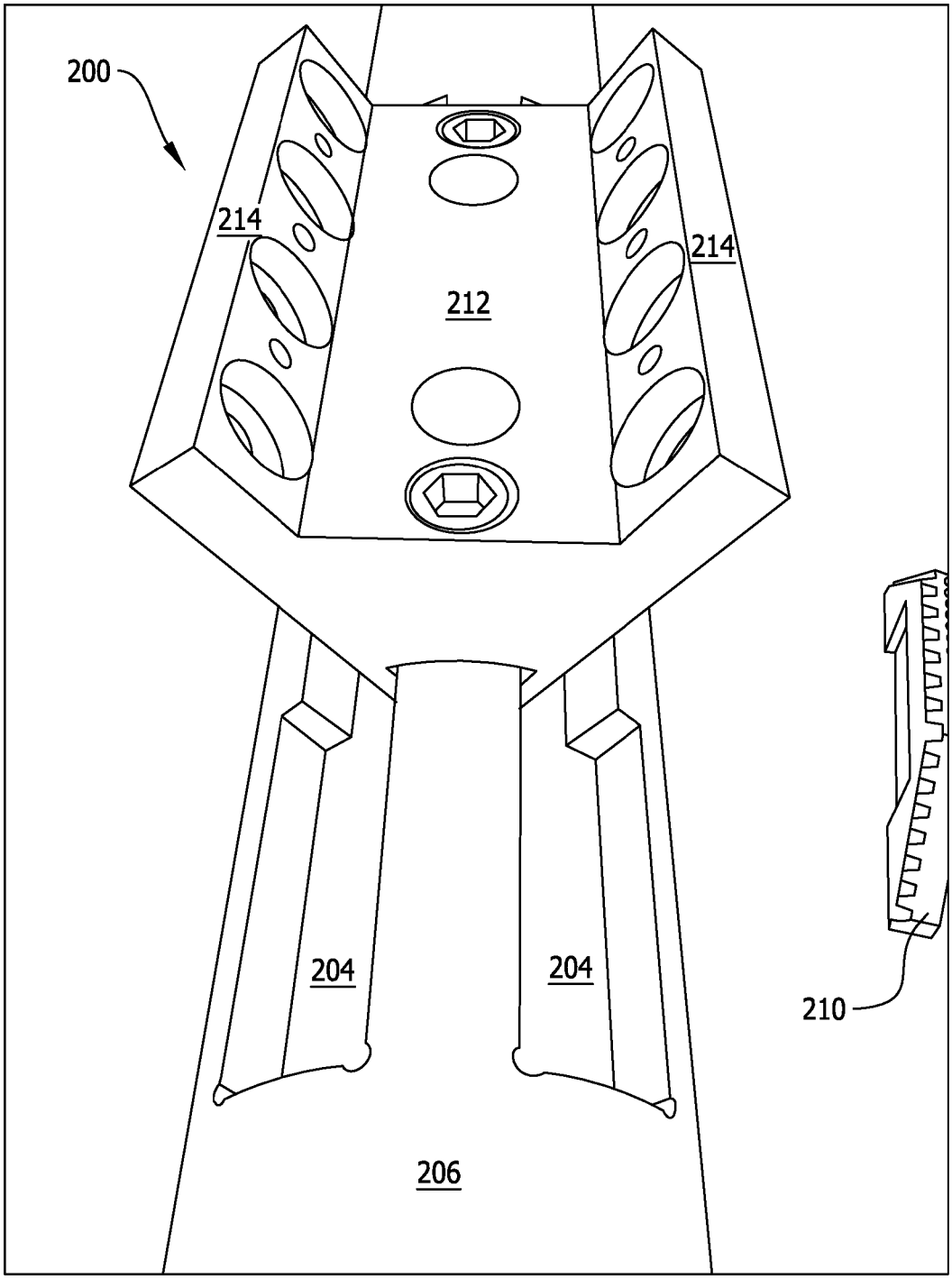
Figure 6:
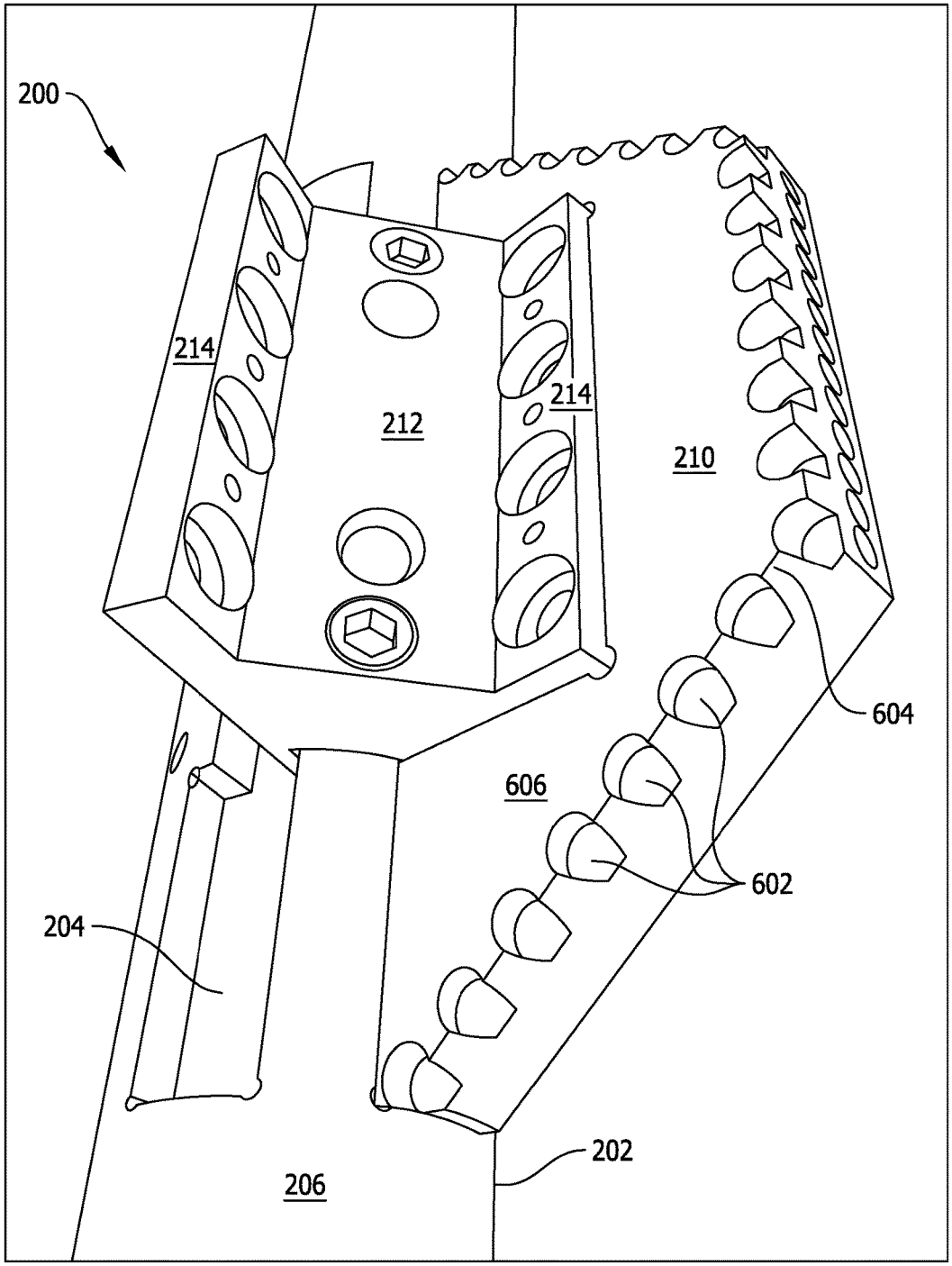
Figure 7:
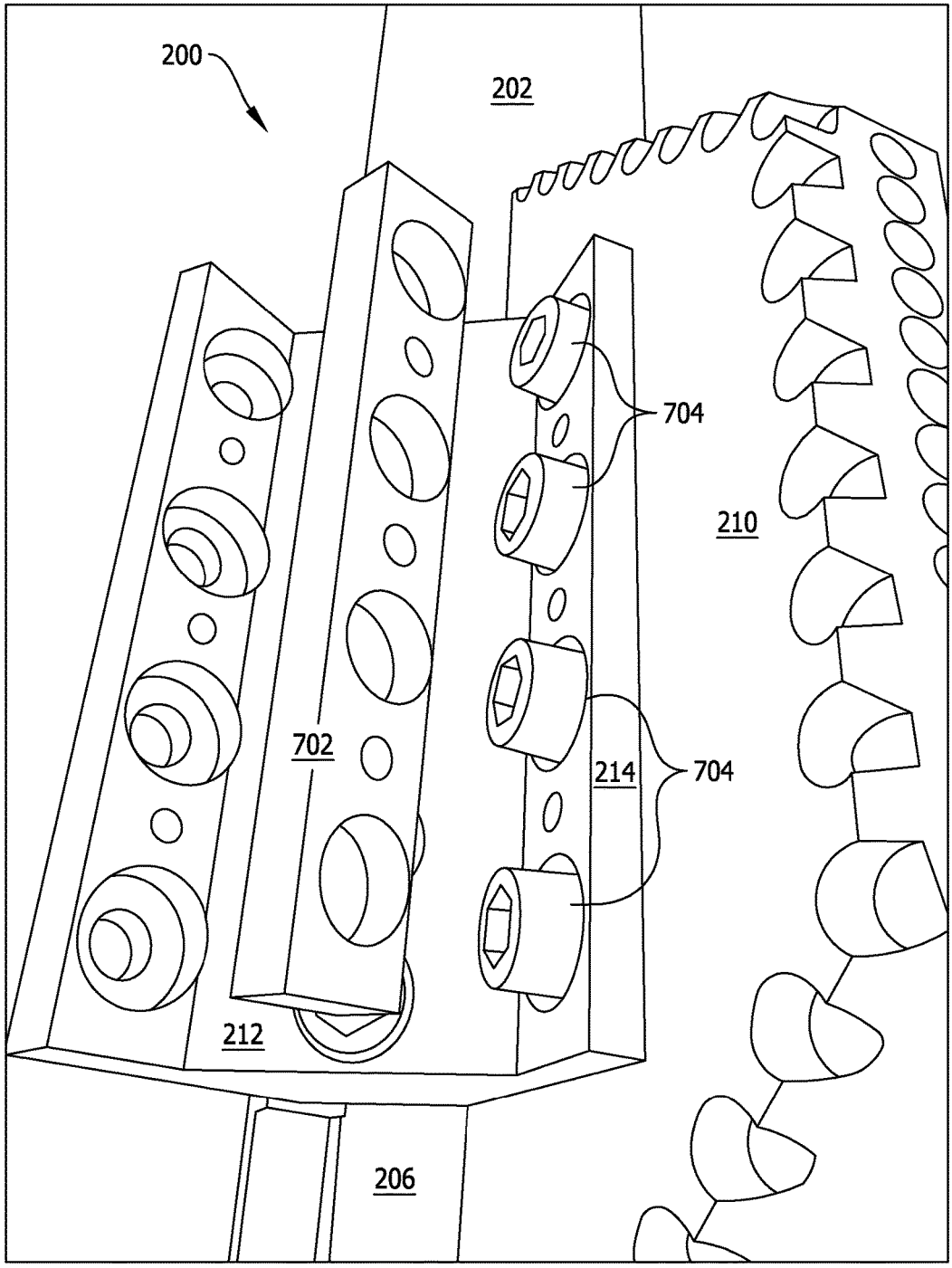

FIG. 3 is a perspective view of hole opener subassembly 200 (shown in FIG. 2) in a disassembled state. FIG. 4 is a perspective view of hole opener subassembly 200 during installation of plate 212. Plate 212 includes a raised spine 402 along a radially inner surface 404 of plate 212. Spine 402 aligns with and is received within an axially aligned slot 406 in outer peripheral surface 206. FIG. 5 is another perspective view of hole opener subassembly 200 during assembly. Plate 212 is coupled to sub shaft 202 using, for example, but not limited to Allen-head cap screws. FIG. 6 is a perspective view of partially assembled hole opener subassembly 200. Blade 210 includes cutouts 602 formed in an outer edge 604 of one side 606 of blade 210. Cutouts 602 are configured to receive cutting bits (not shown in FIG. 3) formed of polycrystalline diamond compact (PDC), which is a compact of a polycrystalline diamond layer and a tungsten carbide substrate. The polycrystalline diamond layer possesses extremely high hardness and abrasion resistance, whereas the tungsten carbide substrate greatly improves a toughness and weldability of the whole compact. FIG. 7 is a perspective view of partially assembled hole opener subassembly 200. After blade 210 is seated in slot 204 (not shown behind blade 210) and coupled to plate 212, a bolt cover 702 is installed over cap screws 704 to protect cap screws 704 from damage during operation.

Figure 8:
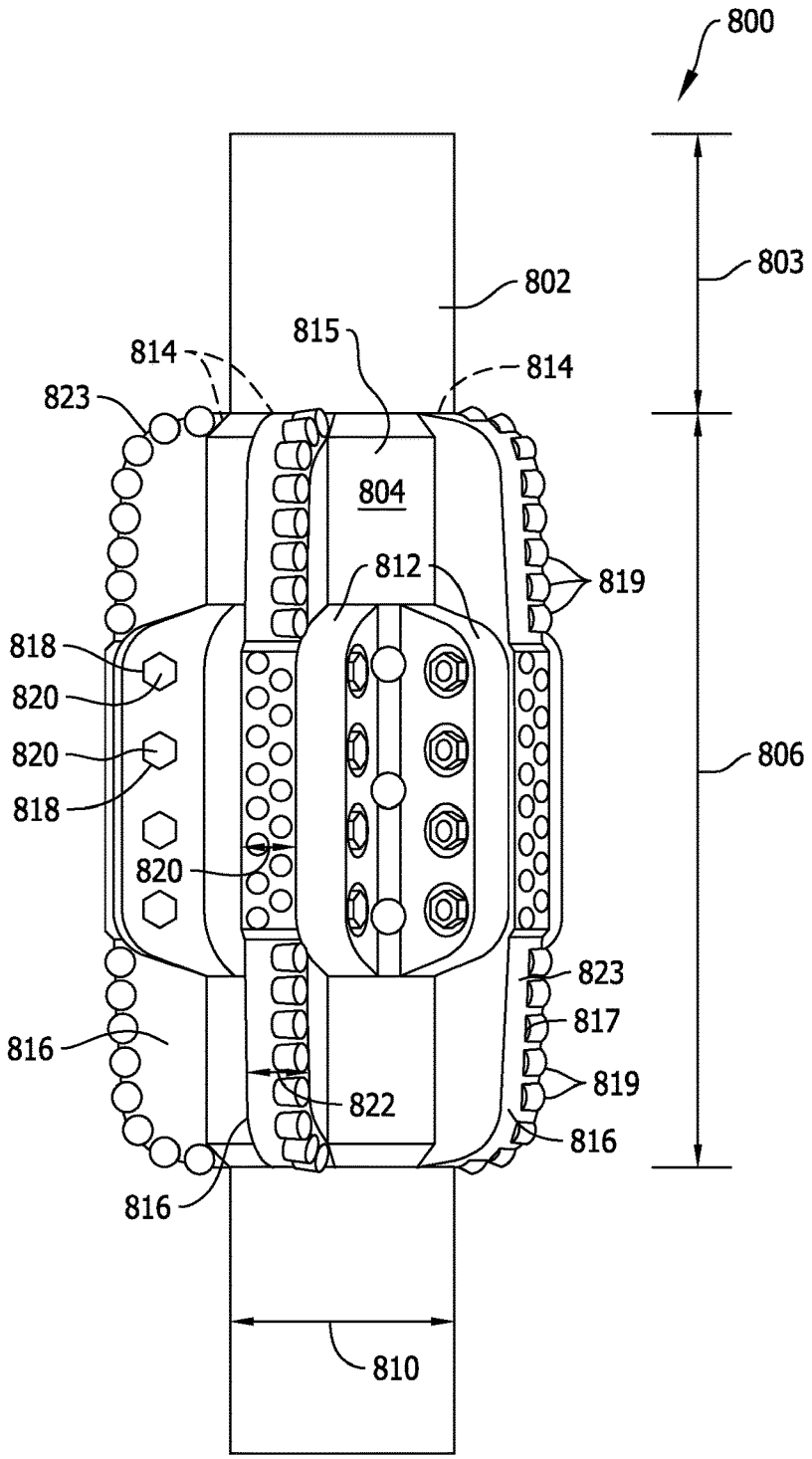
Figure 9:
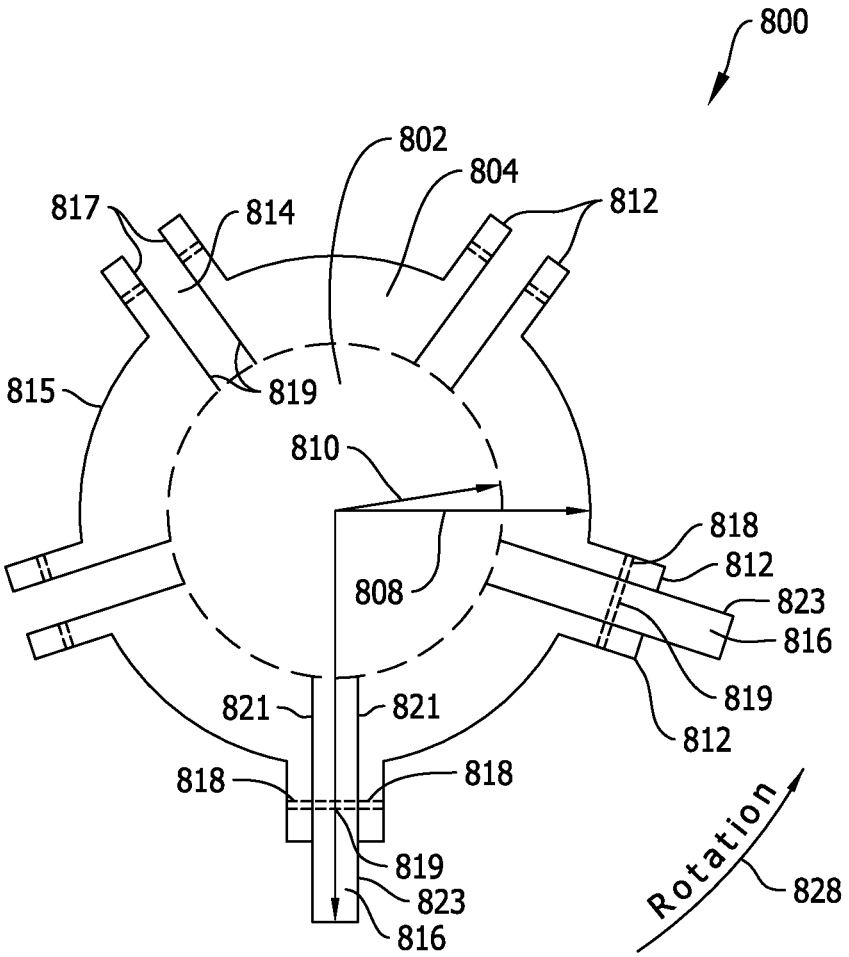

FIG. 8 is a perspective view of a another embodiment of a hole opener subassembly 800. FIG. 9 is an axial view of an end of hole opener subassembly 800. In the example embodiment, hole opener subassembly 800 includes a sub shaft 802 having a first axial portion 803 having a first diameter 810 and a second axial portion 806 having a second diameter 808, second diameter 808 being greater than first diameter 810. Second axial portion 806 includes a plurality of axial slots 814 extending from a surface 815 of second axial portion 806 radially inwardly and spaced circumferentially about second axial portion 806. Second axial portion 806 includes a pair of fastening wings 812 for each of the plurality of axial slots 814 that extend outwardly from surface 815. Adjacent facing surfaces 817 of the pair of fastening wings 812 are align with adjacent facing surfaces 819 of the associated axial slot 814, such that surfaces 817 and 819 form a straight chordwise surface configured to receive outer circumferential surfaces of a blade assembly 816.

Blade assembly 816 includes a straight face 821 configured to engage one of the plurality of axial slots 814. Blade assembly 816 extends radially outwardly from an associated axial slot 814 between a pair of fastening wings 812 associated with axial slot 814. Blade assembly 816 includes a cutting edge 823 that is at least partially arcuate and configured to engage an inner surface of a bore hole. In various embodiments, blade assembly 816 is press fit between a respective pair of fastening wings 812 and/or in a respective axial slot 814. Blade assembly 816 and fastening wings 812 associated with blade assembly 816 include one or more apertures 818 aligned therethrough and configured to receive a mechanical fastener 820 that permits removably coupling blade assembly 816 to hole opener 800. Each blade assembly 816 is selectable from a plurality of blade assemblies 816 in a plurality of different sizes to permit hole opener 800 to form different size bore diameters based on a size of blade assemblies 816 selected. A diameter 824 of blade assembly 816 when fully installed extends beyond diameter 808 and diameter 810 by an amount dependent on the dimension of an installed blade assembly 816. For example, five sets of blade assemblies 816 permit 10-inch, 12-inch, 14-inch, 16-inch, and 18-inch hole sizes. In the example embodiment, one size blade assembly 816 is used for 10-inch diameter blade assemblies 816 and a second size blade assembly 816 is used for the 12-inch, 14-inch, 16-inch, and 18-inch diameter blade assemblies 816. Fastening wings 812 and axial slots 814 support blade assembly 816 when hole opener subassembly 800 is turning in a hole.

Each blade assembly 816 includes a leading edge 826 in a direction 828 of rotation of blade assembly 816 in a bore hole during operation of hole opener 800. Leading edge 826 includes a plurality of teeth or cutting bits 827 coupled to leading edge 826 in at least one of direction 828 and a direction orthogonal to the direction of travel of blade assembly 816 during operation of hole opener 800.

Cutting bits 827 are formed of a material having a hardness greater than a hardness of blade assembly 816 such as, but not limited to, polycrystalline diamond compact (PDC), which is a compact of a polycrystalline diamond layer and a tungsten carbide substrate. The polycrystalline diamond layer possesses extremely high hardness and abrasion resistance, whereas the tungsten carbide substrate greatly improves a toughness and weldability of the whole compact.

During use, blade assemblies 816 are coupled to sub shaft 802 between the plurality of fastening wings 812 and at least partially inserted into slots 814. Blade assemblies 816 are slid radially inwardly between fastening wings 812 and seated in a respective one of the plurality of axial slots 814. Blade assemblies 816 are then coupled to fastening wings 812 to secure them in position.

Figure 10:
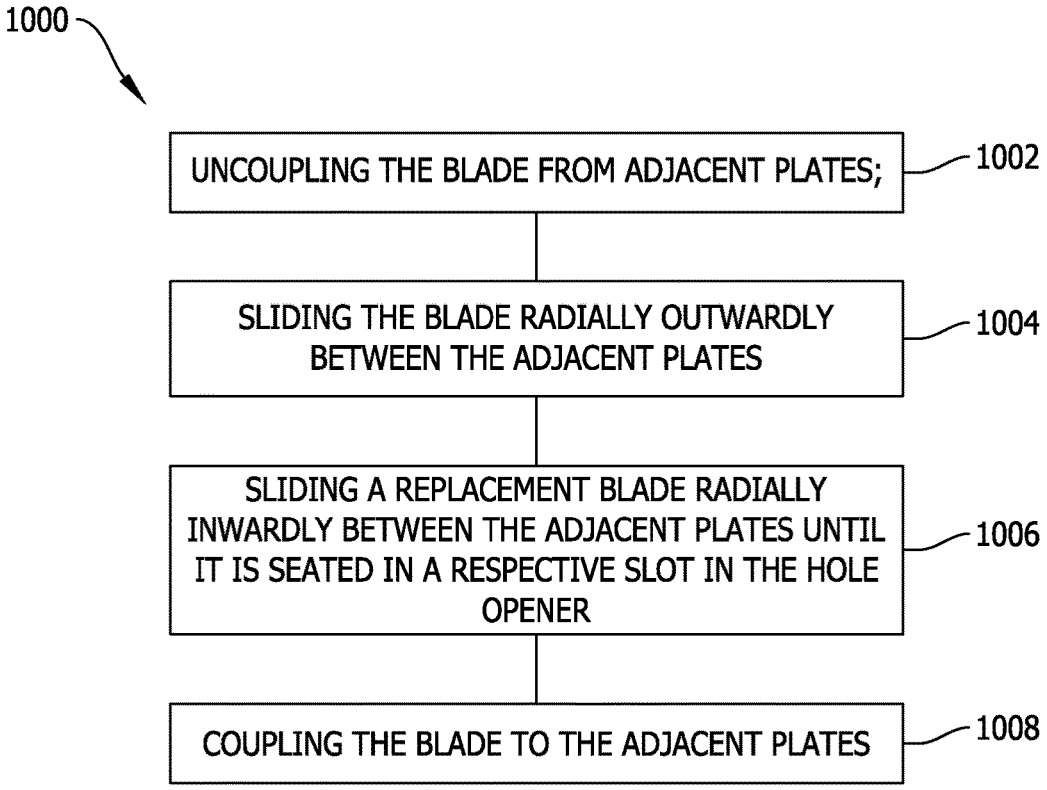

FIG. 10 is a flow diagram of a method 1000 of replacing cutting blades on a hole opener, such as, hole opener subassembly 200. In the example embodiment, method 1000 includes uncoupling 1002 the blade from adjacent plates, sliding 1004 the blade radially outwardly between the adjacent plates, 1006 sliding a replacement blade radially inwardly between the adjacent plates until it is seated in a respective slot in the hole opener, and coupling 1008 the blade to the adjacent plates. Optionally, method 1000 includes removing a fastener cover from a fastening wing of the plate before uncoupling the blade from adjacent plates. Method 1000 also optionally includes uncoupling the blade from a fastening wing extending radially outwardly from the plate when uncoupling the blade from adjacent plates.

This written description uses examples to describe the disclosure, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A hole opener comprising:

a shaft comprising:

a first axially extending portion having a first diameter: and a second axially extending portion having a second diameter, the second diameter being greater than the first diameter, said second axial portion comprising:

a plurality of first axial slots extending from a surface of said second axially extending portion radially inwardly and spaced circumferentially about said second axially extending portion; and a plurality of second axial slots extending from said surface of said second axially extending portion radially inwardly and spaced circumferentially about said second axially extending portion, each of a pair of a first axial slot of said plurality of first axial slots and an adjacent second axial slot of said plurality of second axial slots forming a fastening wing;

a plurality of removable blades, each blade of said plurality of removable blades positioned within a respective one of said plurality of second axially extending slots; and a plurality of mechanical fasteners extending through a respective fastening wing and one of said plurality of removable blades.

2. The hole opener of claim 1, wherein each of said plurality of first axial slots alternate around a circumferential periphery of said second axially extending portion with each of said plurality of second axial slots.

3. The hole opener of claim 1, wherein each of said plurality of removable blades comprises a straight face configured to engage a respective one of said plurality of second axial slots.

4. The hole opener of claim 3, wherein each removable blade of said plurality of removable blades comprises a cutting edge that is at least one of formed with said straight face and coupled to said straight face.

5. The hole opener of claim 4, wherein each cutting edge comprises a radially inner facing surface configured to engage a radially outwardly facing surface of a respective fastening wing.

6. The hole opener of claim 1, wherein each removable blade of said plurality of removable blades extends radially outwardly from a respective one of said plurality of second axial slots between a pair of fastening wings associated with said respective axial slot.

7. The hole opener of claim 1, wherein a plurality of said removable blades comprises a set of blades, each set of blades comprising blades that are identically radially sized, a first set of blades comprising a plurality of first blades having a first radial dimension sized to a first sized hole, a second set of blades comprising a plurality of second blades having a second radial dimension sized to a second sized hole.

8. A hole opener comprising:

a shaft a plurality of plates, each plate having a V-shaped cross-section forming a fastening wing at each leg of said V-shaped cross-section, each plate at least one of coupled to a radially outer surface of said shaft and formed integrally with said shaft, said plurality of plates spaced circumferentially about said shaft such that an axially extending slot having a predetermined width is formed between each pair of adjacent plates; and a plurality of removable blades, each blade of said plurality of removable blades positioned within a respective one of said axially extending slots.

9. The hole opener of claim 8, wherein each axially extending slot is closed at at least one axial end of said axially extending slot.

10. The hole opener of claim 8, wherein each of said plurality of removable blades comprises a straight face configured to engage a respective one of said axially extending slots.

11. The hole opener of claim 10, wherein each removable blade of said plurality of removable blades comprises a cutting edge that is at least one of formed with said straight face and coupled to said straight face.

12. The hole opener of claim 11, wherein each cutting edge comprises a radially inner facing surface configured to engage a radially outwardly facing surface of said shaft.

13. The hole opener of claim 8, wherein each plate is mechanically fastened to said radially outer surface of said shaft using one or more fasteners extending through a crotch of said V-shape.

14. The hole opener of claim 8, wherein a plurality of said removable blades comprises a set of blades, each set of blades comprising blades that are identically radially sized, a first set of blades comprising a plurality of first blades having a first radial dimension sized to a first sized hole, a second set of blades comprising a plurality of second blades having a second radial dimension sized to a second sized hole.

15. The hole opener of claim 8, further comprising a plurality of mechanical fasteners extending through a respective fastening wing and an adjacent removable blade of said plurality of removable blades.

16. A hole opener comprising a shaft comprising a plurality of removable blade receptacles extending radially outward from said shaft, each of the plurality of removable blade receptacles includes a first sidewall and an opposing second sidewall extending axially along said shaft, each of the plurality of removable blade receptacles also includes a slot extending axially between said first and second sidewalls, each slot configured to receive at least a portion of a removable blade.

17. The hole opener of claim 16, wherein said shaft and said plurality of removable blade receptacles are monolithically-formed.

18. The hole opener of claim 16, further comprising a plurality of removable blades extending radially outwardly from each of said plurality of removable blade receptacles, each removable blade comprises a cutting edge and a tab extendable into a slot of a respective removable blade receptacle.

19. The hole opener of claim 18, wherein said plurality of removable blades are mechanically coupled to a respective removable blade receptacle using fasteners.

20. The hole opener of claim 18, wherein said plurality of removable blades are sized to provide a bore of a predetermined diameter and are interchangeable with removable blades of different sizes to provide a bore of a corresponding different diameter.

* * * * *